US006755723B1

(12) United States Patent
Pham

(10) Patent No.: US 6,755,723 B1
(45) Date of Patent: Jun. 29, 2004

(54) POLISHING HEAD ASSEMBLY

(75) Inventor: Xuyen N. Pham, Fremont, CA (US)

(73) Assignee: LAM Research Corporation, Fremont, CA (US)

( * ) Notice: Subject to any disclaimer, the term of this patent is extended or adjusted under 35 U.S.C. 154(b) by 24 days.

(21) Appl. No.: 09/672,605

(22) Filed: Sep. 29, 2000

(51) Int. Cl.[7] ..... B24B 1/100

(52) U.S. Cl. ..... 451/41; 451/287; 451/288; 451/296; 451/307

(58) Field of Search ..... 481/41, 287, 288, 481/296, 307

(56) References Cited

U.S. PATENT DOCUMENTS

| | | | | |
|---|---|---|---|---|
| 3,833,320 A | | 9/1974 | Noll | |
| 4,141,180 A | | 2/1979 | Gill, Jr. et al. | |
| 4,193,226 A | | 3/1980 | Gill, Jr. et al. | |
| 4,194,324 A | * | 3/1980 | Bonora et al. | 451/41 |
| 4,313,284 A | | 2/1982 | Walsh | |
| 5,081,795 A | | 1/1992 | Tanaka et al. | |
| 5,095,661 A | | 3/1992 | Gill, Jr. et al. | |
| 5,335,453 A | | 8/1994 | Baldy et al. | |
| 5,423,558 A | | 6/1995 | Koeth et al. | |
| 5,527,209 A | | 6/1996 | Volodarsky et al. | |
| 5,571,044 A | | 11/1996 | Bolandi et al. | |
| 5,762,544 A | | 6/1998 | Zuniga et al. | |
| 5,989,104 A | | 11/1999 | Kim et al. | |
| 6,083,082 A | | 7/2000 | Saldana | |
| 6,206,754 B1 | * | 3/2001 | Moore | 451/8 |
| 6,234,878 B1 | * | 5/2001 | Moore | 451/41 |
| 6,276,998 B1 | * | 8/2001 | Sommer et al. | 451/41 |

FOREIGN PATENT DOCUMENTS

| | | |
|---|---|---|
| EP | 0 284 343 A3 | 9/1988 |
| EP | 0 362 811 A3 | 4/1990 |
| EP | 0 589 433 A1 | 3/1994 |

* cited by examiner

*Primary Examiner*—Joseph J. Hail, III
*Assistant Examiner*—Shantese McDonald
(74) *Attorney, Agent, or Firm*—Brinks Hofer Gilson & Lion

(57) ABSTRACT

A polishing head assembly for retaining an object that is subject to polishing with a polishing pad is disclosed. The polishing head assembly comprises a head retainer assembly movably coupled to a wafer carrier head. The head retainer assembly includes a gimbal post and a load suspension plate. The gimbal post and the load suspension plate are operable to transfer a loading force to the wafer carrier head during polishing. The gimbal post also provides gimballing to optimize the position of the object in parallel with the polishing pad. In addition, the load suspension plate provides distribution of the loading force to optimize the flatness of the object during polishing.

23 Claims, 8 Drawing Sheets

POLISHING HEAD ASSEMBLY

FIELD OF THE INVENTION

The present invention relates to planarization of semiconductor wafers using a chemical mechanical planarization technique. More particularly, the present invention relates to a wafer polishing head assembly for use in chemical mechanical polishing/planarization of semiconductor wafers.

BACKGROUND

Semiconductor wafers are typically fabricated with multiple copies of a desired integrated circuit design that will later be separated and made into individual chips. Wafers are commonly constructed in layers, where a portion of a circuit is created on a layer and conductive vias are created to electrically connect the circuit to other layers. After each layer of the circuit is etched on the wafer, an oxide layer is put down allowing the vias to pass through but covering the rest of the previous circuit level. Each layer of the circuit can create or add unevenness to the wafer that is typically smoothed before generating the next circuit layer.

Chemical mechanical planarization (CMP) techniques are used to planarize the raw wafer and each layer of material added thereafter. Available CMP systems, commonly called wafer polishers, often use a rotating wafer carrier head that brings the wafer into contact with a polishing pad rotating in the plane of the wafer surface to be planarized. A polishing fluid, such as a chemical polishing agent or slurry containing micro abrasives is applied to the polishing pad to polish the wafer. The wafer is pressed against the rotating polishing pad and is rotated to polish and planarize the wafer. Another CMP technique uses a linear polisher. Instead of a rotating pad, a moving belt is used to linearly move the pad across the wafer surface. The wafer is still rotated to average out the local variations.

The wafer carrier head holds the wafer in place during the polishing operation. In addition, a down force is typically applied to the wafer carrier head to press the wafer into engagement with the polishing pad. The wafer carrier head may also be coupled to a rotating mechanism so that the wafer can rotate while being pressed against a polishing surface. To obtain uniform polishing and planarization of the wafers, the wafer should be maintained generally parallel with the polishing pad.

A known problem can occur when the wafer is not uniformly pressed against the polishing pad or otherwise fails to be maintained generally parallel therewith. The combination of the rotational force and the down force may cause the wafer to tilt downward into the polishing surface. In addition, application of the predetermined force may cause deformation in the wafer carrier head that causes the wafer to be pressed against the polishing surface unevenly. When these conditions occur, nonuniform planarization and/or polishing may occur.

Prior art methods and systems of preventing nonuniform planarization and/or polishing typically involve modifications to the wafer carrier head that are complicated, add considerable weight and require components that involve specialized machining. Accordingly, there is a need for systems and methods of maintaining the wafer carrier head in a plane generally parallel with the polishing pad when the wafer is pressed against the polishing pad that are simple, lightweight and allow relatively simple modification to reflect process conditions.

BRIEF SUMMARY

To alleviate the disadvantages of the prior art, a polishing head assembly is disclosed that includes a head retainer assembly movably coupled to a wafer carrier head. The wafer carrier head is operable to retain a wafer on a bottom surface. The head retainer assembly includes a gimbal post and a load suspension plate that are operable to control the wafer carrier head. Control of the wafer carrier head maintains the wafer carrier head in a plane generally parallel with the polishing pad when a loading force is applied. The loading force is applied to the head retainer assembly to press the wafer into the polishing pad. The head retainer assembly is operable to transfer the loading force to the wafer carrier head using the gimbal post and the load suspension plate.

In addition to transferring the loading force, the head retainer assembly is also operable to optimize the tilt and the deformation of the wafer carrier head. Optimization of the tilt of the wafer carrier head involves using a ball and socket arrangement to allow the wafer carrier head to gimbal with respect to the head retainer assembly. The determination of the optimal location of a gimbal center that effectively cancels a moment force associated with the moving polishing pad optimizes the tilt of the wafer carrier head. When the wafer on the wafer carrier head is brought into contact with the polishing pad, the moment force can cause the wafer carrier head to tilt and unevenly contact the polishing pad. By adjusting the location of the gimbal center based on testing under process conditions, the tilt of the wafer carrier head can be controlled.

The load suspension plate distributes the loading force that is transferred to the wafer carrier head. Control of the distribution of the loading force controls the deformation of the wafer carrier head. Optimization of the flatness of the wafer may be obtained by controlling the deformation of the wafer carrier head. Adjusting the diameter of the load suspension plate controls the deformation of the wafer carrier head and the wafer thereon. The load suspension plate includes a flat circular plate that contacts a region of the wafer carrier head. By adjusting the diameter of the load suspension plate, the region of contact on the wafer carrier head is correspondingly adjusted. Accordingly, the application of the loading force to the wafer carrier head can be controlled to optimize the uniformity of the contact between the wafer and the polishing pad.

Optimization of the tilt and the deformation of the wafer carrier head results in the maintenance of the wafer in a plane that is parallel to the polishing pad when the loading force is applied to the head retainer assembly. Maintenance of the wafer in the parallel plane provides uniform polishing and planarization of the wafer. Accordingly, closer tolerances in the flatness of the wafer can be achieved and consistency of achieving the tolerances can be maintained. The presently preferred wafer polishing assembly is operable to maintain the parallelism of the wafer using the head retainer assembly thereby avoiding complicated modification of the wafer carrier head.

Other features and advantages of the invention will be apparent from the drawings and the more detailed description of the invention that follows. The foregoing discussion of the presently preferred embodiments has been provided only by way of introduction. Nothing in this section should be taken as a limitation on the following claims, which define the scope of the invention.

DETAILED DESCRIPTION OF THE PRESENTLY PREFERRED EMBODIMENTS

Figure 1:
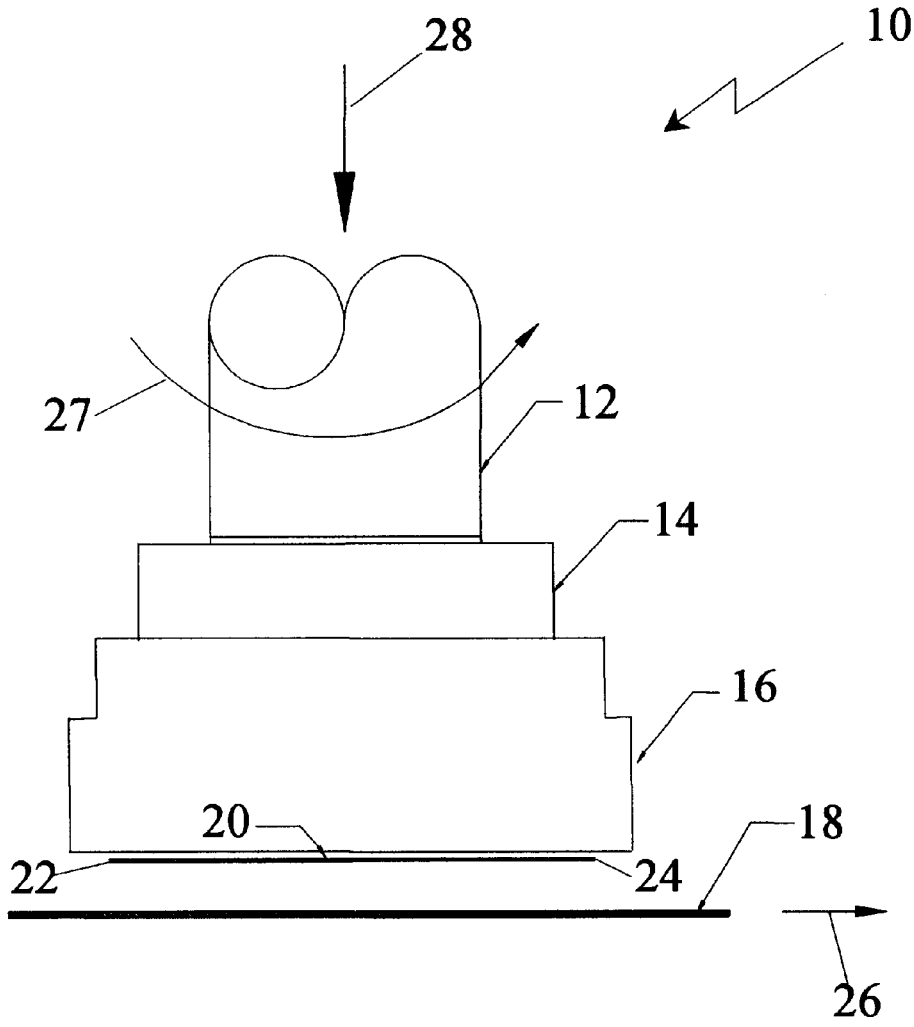
FIG. 1 is a front view of a portion of a polishing apparatus.

A presently preferred embodiment of a portion of a wafer polishing apparatus 10 is generally illustrated in FIG. 1. One example of a wafer polishing apparatus 10 is part of the TERES™ Chemical Mechanical Polishing (CMP) system available from Lam Research Corporation located in Fremont, Calif. FIG. 1 is a front view of the portion of the wafer polishing apparatus 10 that includes a spindle 12, a head exchanger assembly 14, a wafer polishing assembly 16 and a polishing pad 18.

The wafer polishing apparatus 10 is operable to polish and planarize objects that, in the presently preferred embodiment, are a semiconductor wafer 20. Other objects such as, for example, quartz crystals, ceramic elements, lenses, glass plates and other wafer like work pieces may also be planarized and polished by the wafer polishing apparatus 10. The semiconductor wafers 20, hereinafter referred to as wafers 20, are circular shaped discs that are separable into individual chips containing integrated circuits. The wafers 20 include a leading edge 22 and a trailing edge 24 and are retained on a bottom face of the polishing head assembly 16 in the presently preferred embodiment. In alternative embodiments, the wafer 20 could be retained on a side or a top face of the polishing head assembly 16.

The presently preferred wafer polishing apparatus 10 is used in a CMP system to achieve a high accuracy, finished surface on the wafers 20 during processing. Typically, the CMP system receives and processes the wafers 20 through a number of wafer polishing apparatus 10 that provide varying degrees of polishing and planarization. The wafers 20 are retained on the polishing head assembly 16 and transported among one or more of the wafer polishing apparatus 10.

During the polishing operation, the spindle 12 with the head exchanger 14 fixedly coupled thereto are operable to detachably engage the polishing head assembly 16. The elongated spindle 12 comprises part of a spindle drive assembly (not shown) that can be, for example, a robot arm, a screw drive mechanism, a pneumatic mechanism or any other device capable of operatively positioning and rotating the spindle 12. The head exchanger 14 can be any device capable of detachably engaging the polishing head assembly 16, such as, for example, a tool changer or other similar coupling device. The coupling of the spindle 12 and the head exchanger 14 can be by, for example, bolts, rivets, welding or other similar coupling mechanism capable of forming a rigid connection. Detachable connection of the head exchanger 14 and the polishing assembly 16 can be accomplished by, for example, threaded connection, frictional contact, snap fit or any other coupling mechanism that is capable of forming a rigid, secure, detachable connection.

Following coupling of the head exchanger 14 to the polishing head assembly 16, the spindle 12 moves the wafer 20 that is retained on the polishing head assembly 16 into contact with the polishing pad 18. In the presently preferred embodiment, the spindle 12 lowers the wafer 20 to contact a surface of the polishing pad 18. In alternative embodiments, the spindle 12 may raise or laterally move the polishing head assembly 16 to achieve contact between the wafer 20 and the polishing pad 18. In addition, the polishing pad 18 may also be operable to move into contact with the wafer 20. In the presently preferred embodiment, an air bearing (not shown) supports the polishing pad 18 opposite the surface that contacts the wafer 20. The air bearing fixedly maintains the horizontal position of the polishing pad 18.

The presently preferred polishing pad 18 represents an endless polishing surface that is operable to move horizontally in the direction indicated by arrow 26. The polishing pad 18 can be part of, for example, a linear or rotary belt-polishing module (BPM). Movement of the polishing pad 18 provides frictional removal of material from the surface of the wafer 20 using a polishing fluid, such as, for example, a chemical agent or a slurry containing micro abrasives. In addition to the movement of the polishing pad 18, the spindle 12 also rotates in the direction of arrow 27 to facilitate more uniform material removal from the wafer 20. Rotation of the spindle 12 causes rotation of the head exchanger assembly 14, the wafer polishing assembly 16 and the wafer 20. The spindle 12 also applies a loading force illustrated by arrow 28 that presses the wafer 20 into the polishing pad 18.

The wafer polishing assembly 16 is operable to transfer the loading force to the wafer 20. The loading force is controlled to control the rate of material removal from the wafer 20. The presently preferred wafer polishing assembly 16 is operable to transfer the loading force while maintaining the flatness of the wafer 20 in a plane that is parallel to the rotating polishing pad 18. The wafer 20 is maintained in the plane parallel to the polishing pad 18 by counteracting the forces created by the contact of the wafer 20 with the rotating polishing pad 18. The flatness of the wafer 20 is maintained by distributing the loading force applied to the wafer 20. Maintenance of the flatness of the wafer 20 in the plane parallel to the polishing pad 18 optimizes the uniformity of the contact between the surface of the wafer 20 and the surface of the polishing pad 18. Uniformity of the contact results in a more consistent rate of material removal from the surface of the wafer 20 that advantageously improves the consistency and flatness of the surface of the wafer 20.

Figure 2:
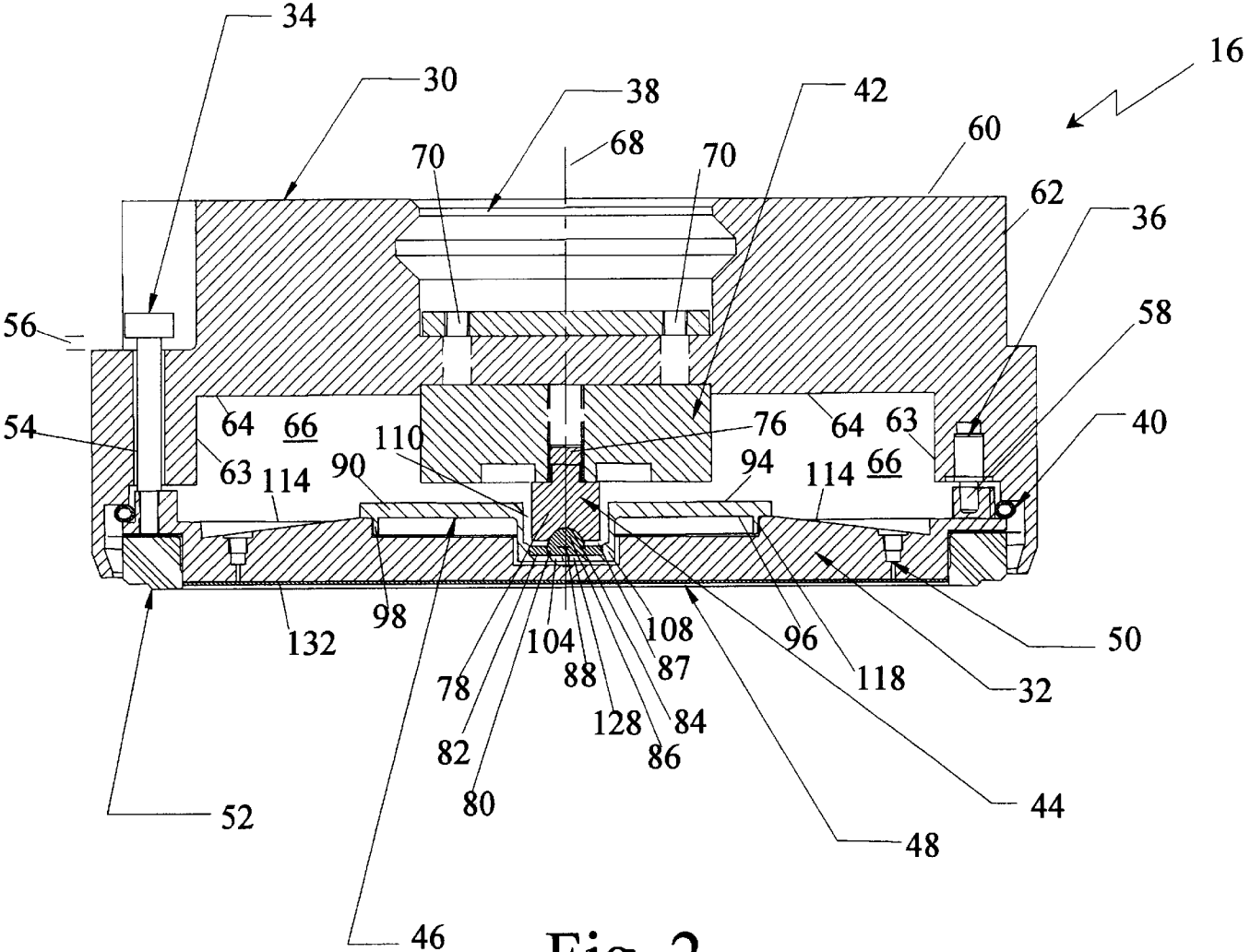
FIG. 2 is a cross section of a presently preferred embodiment of the polishing head assembly illustrated in FIG. 1.

FIG. 2 illustrates a cross-sectional view of the presently preferred wafer polishing assembly 16 illustrated in FIG. 1. The wafer polishing assembly 16 includes a head retainer assembly 30, a wafer carrier head 32, a plurality of retaining bolts 34, a plurality of shear pins 36, a coupler 38, a slurry barrier ring 40, a load cell 42, a gimbal post 44 and a load suspension plate 46. The wafer carrier head 32 includes a carrier film 48, a plurality of vacuum and air ports 50 and a wafer retainer ring 52. During operation, the head retainer assembly 30 works cooperatively with the wafer carrier head 32 to maintain the flatness and parallelism of the wafer 20 (illustrated in FIG. 1) as previously discussed.

The head retainer assembly 30 is movably coupled to the wafer carrier head 32 by the retaining bolts 34. In the preferred embodiment, the retaining bolts 34 are steel shoulder bolts that longitudinally extend through a plurality of bores 54 in the head retainer assembly 30. The bores 54 are formed to allow slidable movement of the retaining bolts 34 in an axial direction. The three uniformly spaced retaining bolts 34 of the presently preferred embodiment are coupled with the wafer carrier head 32 by threaded connection.

A gap 56 is created between the head of the retaining bolts 34 and the head retainer assembly 30 when the wafer carrier head 32 is pressed against the head retainer assembly 30 as illustrated in FIG. 2. Conversely, the gap appears between the wafer carrier head 32 and the head retainer assembly 30 when the wafer carrier head 32 is moved away from the head retainer assembly 30. The gap 56 represents the degree of independent movement of the wafer carrier head 32 with respect to the head retainer assembly 30. In the presently preferred embodiment, the gap 56 is in the range of approximately 0.06 to 0.09 inches.

The shear pins 36 are fixedly coupled to the head retainer assembly 30 and extend there through. A plurality of apertures 58 in the wafer carrier head 32 are formed and positioned to accept the portion of the shear pins 36 that extend from the head retainer assembly 30. In the presently preferred embodiment, there are 3 shear pins 36 formed of steel or similar rigid material. The shear pins 36 are operable to stop the independent rotation of the head retainer assembly 30 with respect to the wafer carrier head 32 when a rotational force is applied to the head retainer assembly 32 by the spindle 12. In other words, the shear pins 36 keep the wafer carrier head 32 aligned and rotating with the head retainer assembly 30 when rotational force is applied to the head retainer assembly 30. In alternative embodiments, the retaining bolts 34 and the shear pins 36 may be any coupling mechanism capable of movably coupling the head retainer assembly 30 to the wafer carrier head 32 as previously described.

A top surface 60 of the head retainer assembly 30 is generally circular with an annular wall 62 that extends from the top surface 60 towards the wafer carrier head 32. Located on the top surface 60 is the coupler 38. The coupler 38 is formed to accept the coupling mechanism 14. The coupling mechanism 14 is operable to fixedly couple the head retainer assembly 30 as previously discussed. The presently preferred coupler 38 illustrated in FIG. 2 is a female portion of a snap fit connection. An interior side surface 63 and a bottom surface 64 of the head retainer assembly 30 forms a cavity 66 within the head retainer assembly 30 that is open to the wafer carrier head 32.

The slurry barrier ring 40 is operable to maintain a seal between the head retainer assembly 30 and the wafer carrier head 32. The slurry barrier ring 40 can be, for example, silicone, rubber or other similar flexible material capable of forming a seal. The seal prevents the entry of foreign material into the cavity 66 during operation of the wafer polishing assembly 16.

The load cell 42 is positioned within the cavity 66 adjacent to the coupler 38 and concentric with a central axis 68 of the wafer polishing assembly 16. The load cell 42 operates to measure the loading force applied by the spindle 12 to the wafer carrier head 32. The load cell 42 is fixedly coupled to the head retainer assembly 30 by a plurality of bolts 70. In the presently preferred embodiment, the load cell 42 may be supplied by Transducer Techniques or Interface Inc. and is operable to measure the loading force in the range between 500 to 1000 pounds. The load cell 42 is fixedly coupled to gimbal post 44.

The gimbal post 44 includes a proximal end 76 that is fixedly coupled to the load cell 42 by, for example, welding, threaded connection, adhesive connection or other similar rigid connection mechanism. In the presently preferred embodiment, the load cell 42 is coupled to the gimbal post 44 by threaded connection. The coupling between the load cell 42 and the proximal end 76 of the gimbal post 44 allows the transfer of the loading force that is applied to the head retainer assembly 30 to the gimbal post 44. Accordingly, the load cell 42 may measure the loading force applied to the gimbal post 44.

The gimbal post 44 of the presently preferred embodiment comprises a first section 78 and a second section 80. The first section 78 includes the proximal end 76 and the second section 80 includes a distal end 82. The first section 78 also includes a concave area 84 that is spherically shaped. The concave area 84 is positioned adjacent the second section 80. The concave area 84 of the first section 78 operably cooperates with a convex area 86 of the second section 80 that is also spherically shaped. The convex area 86 is positioned adjacent the first section 78 to engage the concave area 84 and create a gap 87. In the presently preferred embodiment, the gap 87 is in the range of approximately 0.03 to 0.06 inches.

Operable cooperation of the first and second sections 78, 80 forms a ball and socket configuration that allows the second section 80 to gimbal or tilt with respect to the first section 78. The gimballing action provides the ability of a portion of the wafer polishing assembly 16 to tilt as will be later described. The convex area 86 corresponds to a gimbal center 88. The gimbal center 88 represents a point at the center of an imaginary sphere created by completing the partial sphere formed by the convex area 86 as illustrated in FIG. 2. The 5 adjustment of the location of the gimbal center 88 effectively adjusts the behavior of the tilt as will be hereinafter described. The sections 78, 80, of the presently preferred embodiment, could be formed of polyethylene terephthalate (PET) or stainless steel with a PET covering. In alternative embodiments, the gimbal post 44 could be formed of other materials such as, for example, aluminum, carbon fiber or other similar rigid material capable of receiving and transferring the loading force. The gimbal post 44 is operable to transfer the loading force to the load suspension plate 46.

Figure 3:
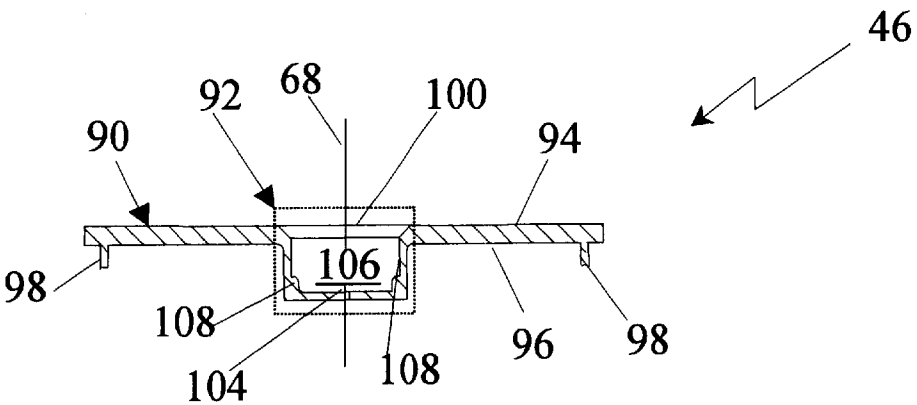
FIG. 3 is a cross section of a presently preferred load suspension plate that forms part of the polishing head assembly illustrated in FIG. 2.

The load suspension plate 46 is operable to receive and transfer the loading force to the wafer carrier head 32. FIG. 3 illustrates the load suspension plate 46 illustrated in FIG. 2 removed from the head retainer assembly 30. The presently preferred load suspension plate 46 comprises a load control ring 90 that circumferentially surrounds a gimbal area 92. The load control ring 90 is a generally circular rigid flat plate that includes a first surface 94 and a second surface 96. An annular raised channel 98 is formed on the second surface 96 at a predetermined distance from the central axis of the load control ring 90. The load control ring 90 radially extends from the gimbal area 92 that is positioned on the central axis 68 of the wafer polishing assembly 16.

The presently preferred gimbal area 92 is defined by an aperture 100, an annular wall 102 and an end plate 104. The annular wall 102 circumferentially surrounds the aperture 100 and longitudinally extends a predetermined distance from the second surface 96 of the load control ring 90 to the end plate 104. The annular wall 102 and the end plate 104 are integrally formed to create a cavity 106. In the presently preferred embodiment, the load suspension plate 46 may be formed of stainless steel or other similar rigid material capable of transferring the loading force.

Referring now to FIGS. 2 and 3, the aperture 100 is formed to allow insertion of the gimbal post 44 into the cavity 106. During operation, prior to application of the loading force to the wafer polishing assembly 16, the second section 80 is positioned to engage the load suspension plate 46. The second section 80 is in contact with the interior surface of the end plate 104 and a raised area 108 of the annular wall 102 to prohibit lateral movement of the second section 80. The first section 78 is positioned in the cavity 106 away from the second section 80. When the loading force is applied, the first section 78 moves further into the cavity 106 such that the concave area 84 engages the convex area 86 of the second section 80. The first section 78 of the gimbal post 44 remains separated from the annular wall 102 by a gap 110 to facilitate gimballing. In the presently preferred embodiment, the gap 110 is in the range of approximately 0.06 to 0.09 inches.

During operation, the loading force applied to the gimbal post 44 is transferred to the load suspension plate 46 through the distal end 82 of the second section 80. The load suspension plate 46 is operable to distribute the loading force that is concentrated in the gimbal area 92 by the gimbal post 44. The loading force is distributed and transferred to the wafer carrier head 32 by the load control ring 90.

Figure 4:
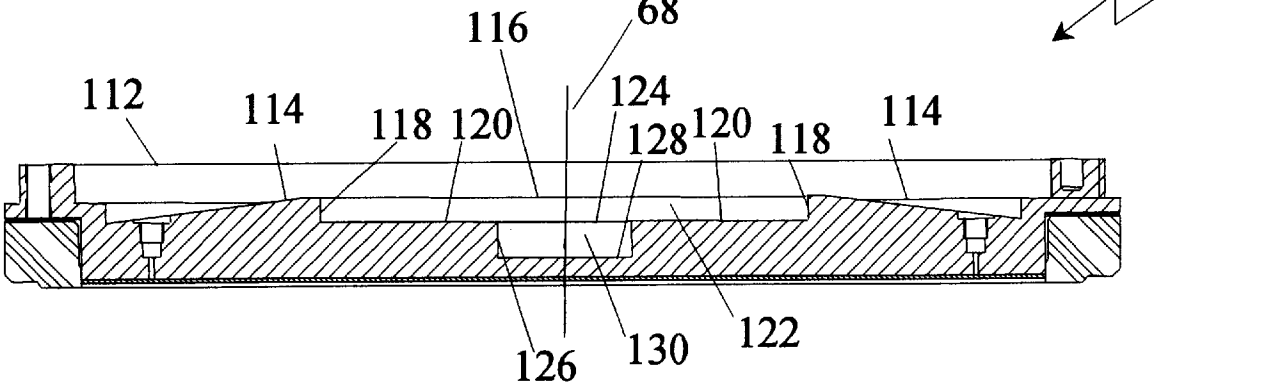
FIG. 4 is a cross section of a presently preferred wafer carrier head that forms part of the polishing head assembly illustrated in FIG. 2.

FIG. 4 illustrates the presently preferred wafer carrier head 32 illustrated in FIG. 2 removed from the wafer polishing assembly 16. The wafer carrier head 32 can be any mechanism capable of detachably retaining the wafer 20 (illustrated in FIG. 1) and engaging the load suspension plate 46. The wafer carrier head 32 is a generally circular structure of a predetermined thickness that may be formed of metal or other similarly rigid and non-flexible material. In the presently preferred embodiment the wafer carrier head 32 is formed of stainless steel and is approximately 0.65 inches thick.

The wafer carrier head 32 includes an annular wall 112 that is concentric with the central axis 68 and longitudinally extends to a top surface 114. The annular wall 112 circumferentially surrounds the load suspension plate 46 (illustrated in FIGS. 2 and 3) and is adjacent to the head retainer assembly 30 (illustrated in FIG. 2). The top surface 114 is positioned adjacent the load suspension plate 46 and closes the open end of the cavity 106. A first aperture 116 is formed in the top surface 114 concentric with the central axis 68 of the wafer polishing assembly 16. Extending longitudinally away from the top surface 114 and circumferentially surround the first aperture 116 is a first annular wall 118. The first annular wall 118 extends to a first floor 120. The first annular wall 118 and the first floor 120 define a first cavity 122. A second aperture 124 is formed in the first floor 120 concentric with the first aperture 116. The second aperture 124 similarly has a longitudinally extending second annular wall 126 that extends to a second floor 128 that defines a second cavity 130. The first and second apertures 116, 124 are formed to operably receive the load suspension plate 46.

Referring now to FIGS. 2 and 4, the bottom surface 96 and the annular raised channel 98 of the load suspension plate 46 engage the top surface 114 and the first annular wall 118, respectively, of the wafer carrier head 32. In addition, the exterior surface of the end plate 104 is suspended above the second floor 128. During operation, the loading force is transferred to the wafer carrier head 32 in a region defined by the engagement of the bottom surface 96 and the annular raised channel 98 with the top surface 114 and the first annular wall 118, respectively. Since the wafer carrier head 32 is formed of non-flexible material, the end plate 104 does not contact the second floor 128 when the loading force is applied.

Referring again to FIGS. 1 and 2, the wafer 20 is positioned on a bottom surface 132 of the wafer carrier head 32 in parallel with the bottom surface 132. The carrier film 48 is located between the bottom surface 132 and the wafer 20. The carrier film 48 may be any porous, supple material capable of retaining liquid and providing adhesion of the wafer 20 to the wafer carrier head 32. In the presently preferred embodiment, the carrier film 48 is a felt material that is glued to the bottom surface 132 using an adhesive material. The wafer 20 is also maintained on the bottom surface 132 by the vacuum and air ports 50 and the wafer retainer ring 52. During operation, when the wafer polishing assembly 16 is not in contact with the polishing pad 18 (illustrated in FIG. 1), the vacuum and air ports 50 are activated to create a vacuum that operates to adhere the wafer 20 to the bottom surface 132. In addition, the vacuum and air ports 50 are operable to provide positive pressure during removal of the wafer 20 from the bottom surface 132. During the polishing operation, the wafer retainer ring 52 retains the wafer 20 on the bottom surface 132 of the wafer carrier head 32.

Referring now to FIGS. 1, 2, 3 and 4, a discussion of the overall operation of the presently preferred wafer polishing assembly 16 will now be provided. When the wafer 20, which is positioned on the wafer carrier head 32, is brought into contact with the polishing pad 18 by the spindle 12, the loading force (illustrated as arrow 28 in FIG. 1) is applied. The wafer retainer ring 52 maintains the wafer 20 on the bottom surface 132 despite the rotation of the polishing pad 18 (illustrated by arrow 26 in FIG. 1) and the rotation of wafer 20 (illustrated by arrow 27 in FIG. 1). In addition, the wafer 20 is retained in a plane parallel to the polishing pad 18 by controlling the tilt of the wafer carrier head 32 with the gimbal post 44 and distributing the loading force on the wafer carrier head 32 with the load suspension plate 46.

Selecting the height of the gimbal center 88 with respect to the plane the wafer 20 occupies, or similarly the bottom surface 132, controls the tilt of the wafer carrier head 32. Those skilled in the art would understand that the frictional contact of the wafer 20 and the rotating polishing pad 18 creates a moment force that causes the leading edge 22 of the wafer 20 to move downward into the polishing pad 18. The moment force (i.e. the downward movement of the wafer 20) can be cancelled by adjusting the gimbal center 88, as known in the art.

As the gimbal center 88 is adjusted to be more above the plane the wafer 20 occupies, the leading edge 22 of the wafer 20 tilts more downward and the trailing edge 24 tilts more upward. As the gimbal center 88 is adjusted more below the plane that the wafer 20 is in, the leading edge 22 tilts more upward and the trailing edge 24 tilts more downward. Accordingly, by testing with different positions of the gimbal center 88 with respect to wafer 20, the tilt of the wafer 20 can be optimized. In the presently preferred embodiment, the gimbal center 88 may be adjusted by changing the vertical position of the concave area 84 and convex area 86.

Alternatively, the size of the concave and convex areas 84, 86 may be adjusted thereby adjusting the diameter of the imaginary sphere as previously discussed. The tilt of the presently preferred wafer carrier head 32 with respect to the central axis 68 of the wafer polishing assembly 16 is in the range of about 1 to 2 degrees.

Distribution of the loading force by the load suspension plate 46 controls the deformation of the wafer carrier head 32. When the loading force is applied, deformation of the wafer carrier head 32 occurs. The degree and nature of the deformation of the wafer carrier head 32 is dependent on the structural configuration and material the wafer carrier head 32 is formed of. In the presently preferred embodiment, the distribution of the loading force controls the deformation of the wafer carrier head 32 to optimize the flatness of the wafer 20 with respect to the polishing pad 18. As previously discussed, optimization of the flatness of the wafer 20 more closely maintains the wafer 20 in a plane that is parallel to the polishing pad 18. Adjustment of the distribution of the loading force may be achieved by adjusting the diameter of the load control ring 90. Adjusting the diameter of the load control ring 90 correspondingly changes the location of the region on the wafer carrier head 32 where the loading force is applied.

The adjustment of the diameter of the load control ring 90 is dependent on the optimization of the deformation of the wafer carrier head 32 by the loading force during operation. The diameter of the load control ring 90 may be adjusted between the diameter of the gimbal post 44 and the diameter of the bottom surface 132 of the wafer carrier head 32 to optimize the flatness of the wafer 20. In the presently preferred embodiment, the diameter of the load control ring 90 may be adjusted between about 40% and 60% of the diameter of the bottom surface 132 of the wafer carrier head 32.

Determination of the optimal position of the gimbal center 88 and the optimal diameter of the load control ring 90 is accomplished through testing. The testing is performed under process conditions to determine the effect on the position of the wafer 20 with respect to the polishing pad 18 as the gimbal center 88 and the diameter of the load control ring 90 are varied. The optimal location of the gimbal center 88 and the optimal diameter of the load control ring 90 will position the wafer 20 in a plane that is parallel to the polishing pad 18 and maintain the optimal flatness of the wafer 20. Other embodiments may be considered based on the affect of the process parameters on the tilt and the loading distribution on the wafer carrier head 32. The process parameters effecting the tilt and loading distribution may include, for example, the pressure of the loading force, the rotational speed of the wafer polishing assembly 16, the rotational speed of the polishing pad 18, the polishing fluid, the roughness of the polishing pad 18, etc.

Figure 5:
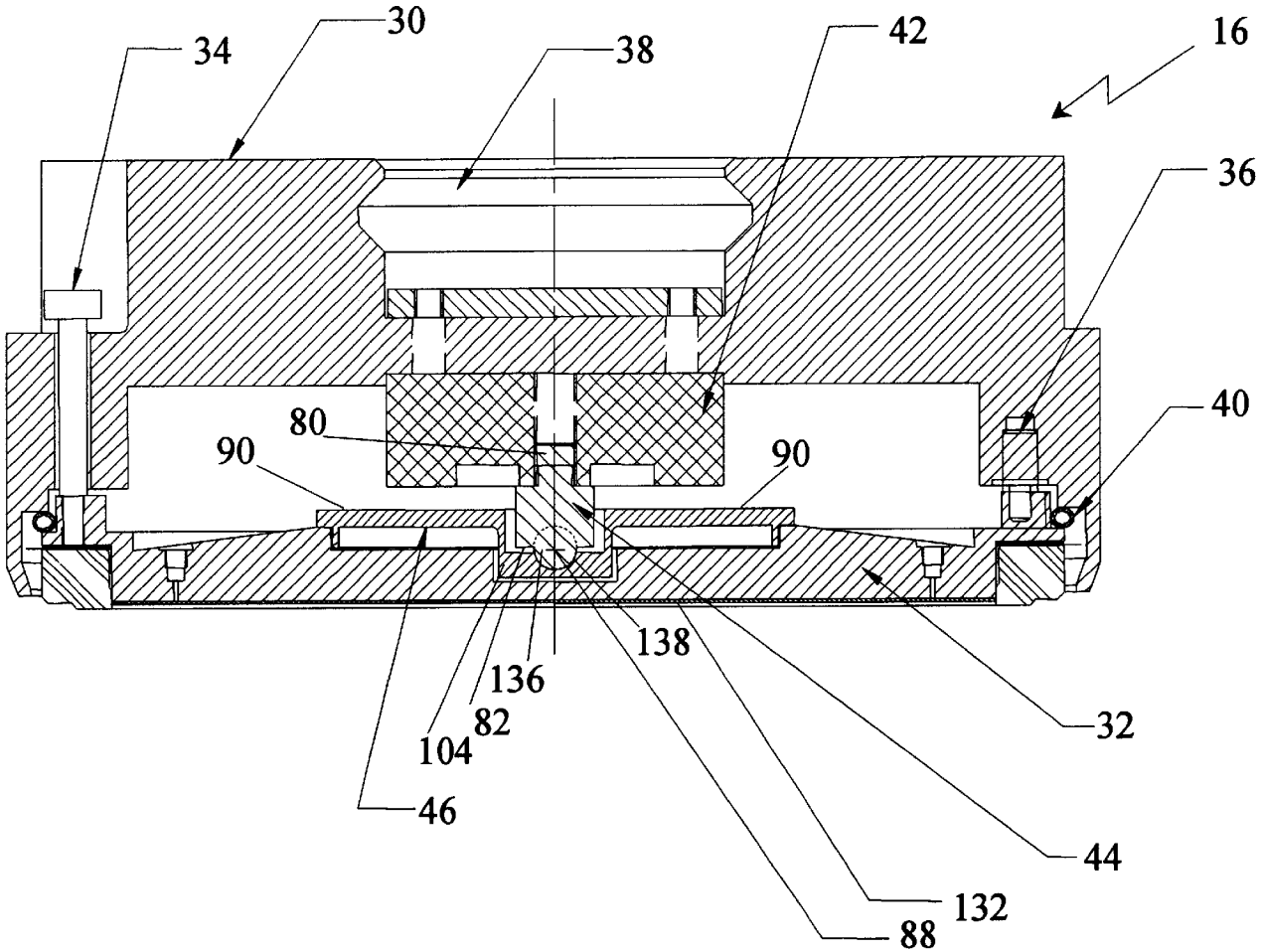
FIG. 5 is a cross section of another presently preferred embodiment of the polishing head assembly illustrated in FIG. 1.

FIG. 5 is a cross section of another preferred embodiment of the polishing head assembly 16 illustrated in FIG. 1. In this embodiment, the ahead retainer assembly 30 and the wafer carrier head 32 are movably coupled using the retaining bolts 34 and the shear pins 36 and operate in a similar fashion to the polishing head assembly 16 illustrated in FIG. 2. In addition, the position and operation of the coupler 38, the slurry barrier ring 40 and the load cell 42 are also similar. Further, the gimbal post 44 and the load suspension plate 46 are similarly operable to transfer the loading force to the wafer carrier head 32. However, the design and operable cooperation of the gimbal post 44 and the load suspension plate 46 is different. For purposes of brevity, the following discussion will focus on the differences of this embodiment with the previously discussed embodiments.

The gimbal post 44 of this embodiment comprises a single structure with the proximal and distal ends 80, 82. The proximal end 80 of the gimbal post 44 is fixedly coupled to the load cell 42 as in the embodiment illustrated in FIG. 2. The distal end 82 of the gimbal post 44 of this embodiment includes a convex area 136. The convex area 136 is formed to operably engage a concave area 138 that is formed in the interior surface of the end plate 104 of the load suspension plate 46. The convex area 136 and the concave area 138 operably cooperate as a ball and socket to allow the load suspension plate 46 and the wafer carrier head 32 to gimbal with respect to the head retainer assembly 30 during operation. In an alternative embodiment, the convex area 136 may be formed in the load suspension plate 46 and the concave area 138 may be formed at the distal end 82 of the gimbal post 44.

When the loading force is applied to the head retainer assembly 30, the gimbal post 44 engages the load suspension plate 46. The resulting gimballing action is operable to maintain the bottom surface 132 of the wafer carrier head 32 in a plane that that is parallel to the polishing pad 18 (illustrated in FIG. 1). Similar to the embodiment illustrated in FIG. 2, the gimbal center 88 of the convex area 136 is adjustable. In the embodiment illustrated in FIG. 5, the gimbal center 88 may be positioned above the plane occupied by the bottom surface 132.

As in the embodiment illustrated in FIG. 2, the load suspension plate .46 is operable to distribute the loading force acting on the wafer carrier head 32. In addition, the diameter of the load control ring 90 of the load suspension plate 46 may be adjusted to control the deformation of the wafer carrier head 32. The diameter of the load control ring 90 may be in a range between the diameter of the gimbal post 44 and the diameter of the bottom surface 132 to control the deformation of the wafer carrier head 32. In the presently preferred embodiment, the diameter of the load control ring 90 may be adjusted between about 40% and 60% of the diameter of the bottom surface 132 of the wafer carrier head 32 to optimize the flatness of the wafer 20 (FIG. 1).

Figure 6:
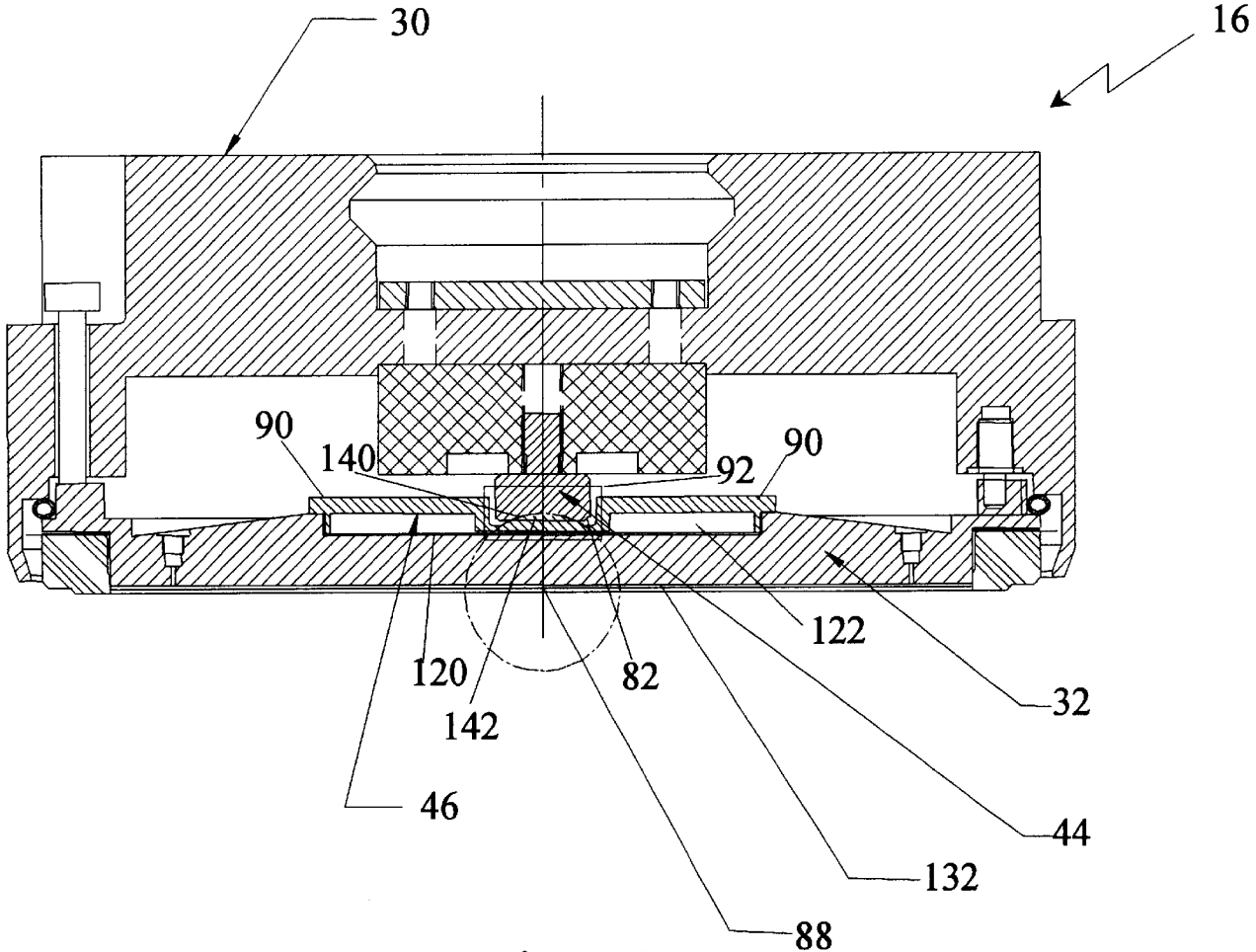
FIG. 6 is a cross section of another presently preferred embodiment of the polishing head assembly illustrated in FIG. 1.

FIG. 6 illustrates a cross-sectional view of another presently preferred embodiment of the wafer polishing assembly 16 illustrated in FIG. 1. This embodiment similarly includes the head retainer assembly 30 and the wafer carrier head 32 that cooperatively operate similarly to the previously set forth embodiments. In addition, the load cell 42 is fixedly coupled to the gimbal post 44 as in the embodiment illustrated in FIG. 2. Further, the gimbal post 44 and the load suspension plate 46 of this embodiment form a ball and socket that allows the load suspension plate 46 and the wafer carrier head 32 to gimbal with respect to the head retainer assembly 30. However, in this embodiment, a concave area 140 may be formed at the distal end 82 of the gimbal post 44 and a convex area 142 may be formed in the load suspension plate 46. In an alternative embodiment, the concave area 140 may be formed in the load suspension plate 46 and the convex area 142 may be formed at the distal end 82 of the gimbal post 44.

In the illustrated embodiment, the location of the gimbal center 88 may be positioned in or near the plane that the bottom surface 132 of the wafer carrier head 32 occupies. The position of the gimbal center 88 is achieved by increasing the size of the convex area 142 and eliminating the second cavity 130 of the embodiment illustrated in FIG. 2. Elimination of the second cavity 130 suspends the gimbal area 92 (best illustrated in FIG. 3) of the load suspension plate 46 above the first floor 120 within the first cavity 122. In the presently preferred embodiment the wafer carrier head 32 is formed of stainless steel and is approximately 0.65 inches thick.

Similar to the previously discussed embodiments, the diameter of the load control ring 90 may be adjusted between the diameter of the gimbal post 44 and the diameter of the bottom surface 132 of the wafer carrier head 32 to optimize the flatness of the wafer 20. In the presently preferred embodiment, the diameter of the load control ring 90 may be adjusted between about 40% and 60% of the diameter of the bottom surface 132 of the wafer carrier head 32 to optimize the flatness of the wafer 20 (FIG. 1). The position of the region of contact on the wafer carrier head 32 is similar to the embodiment illustrated in FIG. 2 and is determined by the diameter of the load control ring 90.

Figure 7:
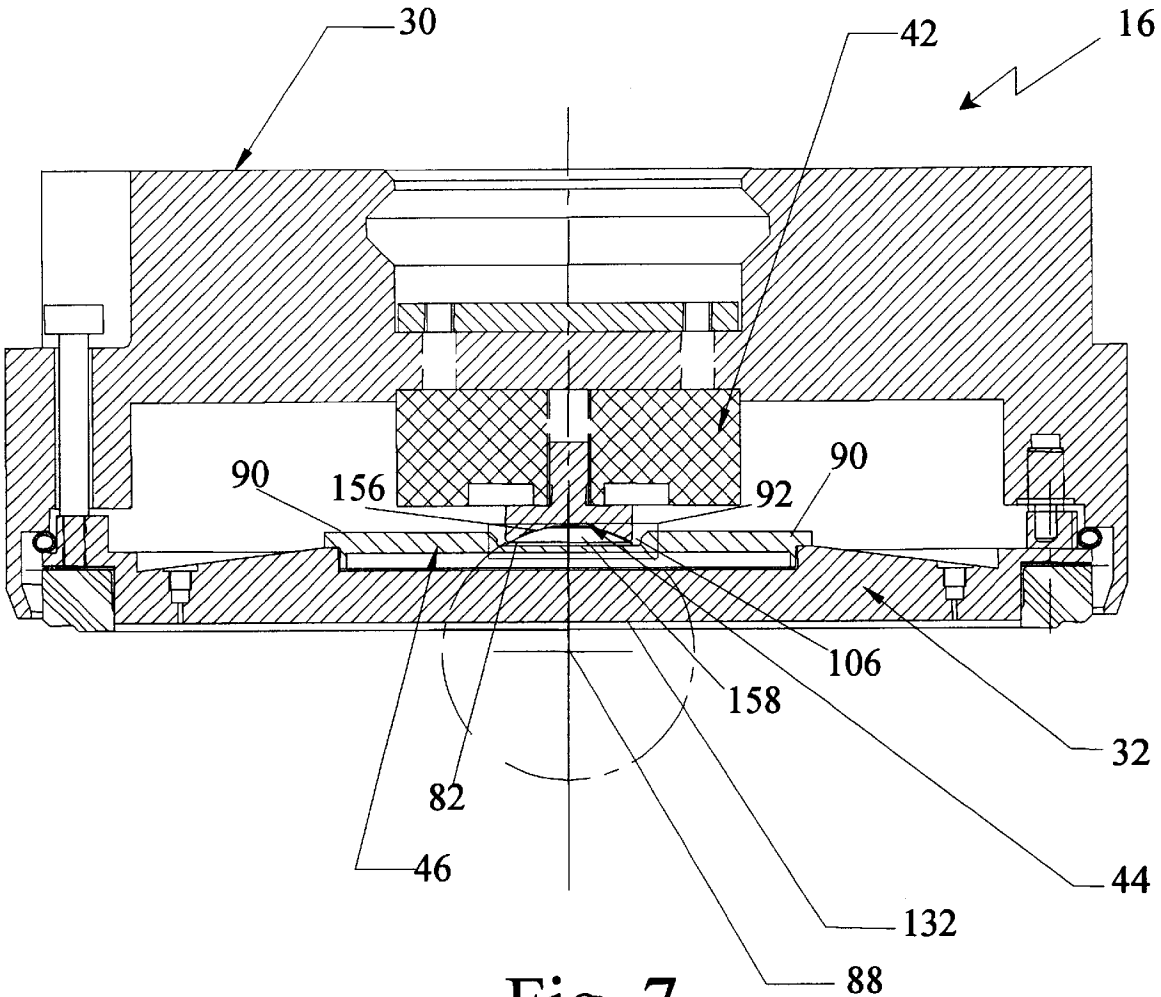
FIG. 7 is a cross section of another presently preferred embodiment of the polishing head assembly illustrated in FIG. 1.

FIG. 7 is a cross sectional view of another preferred embodiment of the polishing head assembly 16 illustrated in FIG. 1. In this embodiment, the polishing head assembly 16 includes the head retainer assembly 30 movably connected to the wafer carrier head 32 as in the previous embodiments. In addition, the load cell 42 measures the loading force applied to the gimbal post 44. The gimbal post 44 is fixedly coupled to the load cell 42 as in the embodiment illustrated in FIG. 2. The distal end 82 of the gimbal post 44 includes a concave area 156 that cooperatively operates with a convex area 158 on the load suspension plate 46 in a ball and socket fashion. The convex area 158 provides the gimbal center 88 that is illustratively positioned in the preferred embodiment of FIG. 7 below the bottom surface 132 of the wafer carrier head 32. As previously discussed, the gimbal center 88 may be adjusted by changing the position of the convex area 158 or the diameter of the portion of the sphere created thereby. In this embodiment, the distance of the gimbal center 88 below the bottom surface 132 of the wafer carrier head 32 may be in a range of about 0 to 0.5 inches.

The load suspension plate 46 includes the load control ring 90 and the gimbal area 92 (best illustrated in FIG. 4) as in the previously discussed embodiments. However, the gimbal area 92 of this embodiment has been adjusted to change the position of the convex area 158. Adjustment of the gimbal area 92 may be accomplished by reducing the area that defines the cavity 106 as illustrated. During operation, the load suspension plate 46 only transfers the loading force to the wafer carrier head 32 using the load control ring 90 as in the previously discussed embodiments. Accordingly, the gimbal area 92 does not contact the wafer carrier head 32. In the presently preferred embodiment the wafer carrier head 32 is formed of stainless steel and is approximately 0.65 inches thick.

Similarly to the previous embodiments, the diameter of the load control ring 90 may be in a range between the diameter of the gimbal post 44 and the diameter of the bottom surface 132 to control the deformation of the wafer carrier head 32. In the presently preferred embodiment, the diameter of the load control ring 90 may be adjusted between about 40% and 60% of the diameter of the bottom surface 132 of the wafer carrier head 32 to optimize the flatness of the wafer 20 (FIG. 1).

Figure 8:
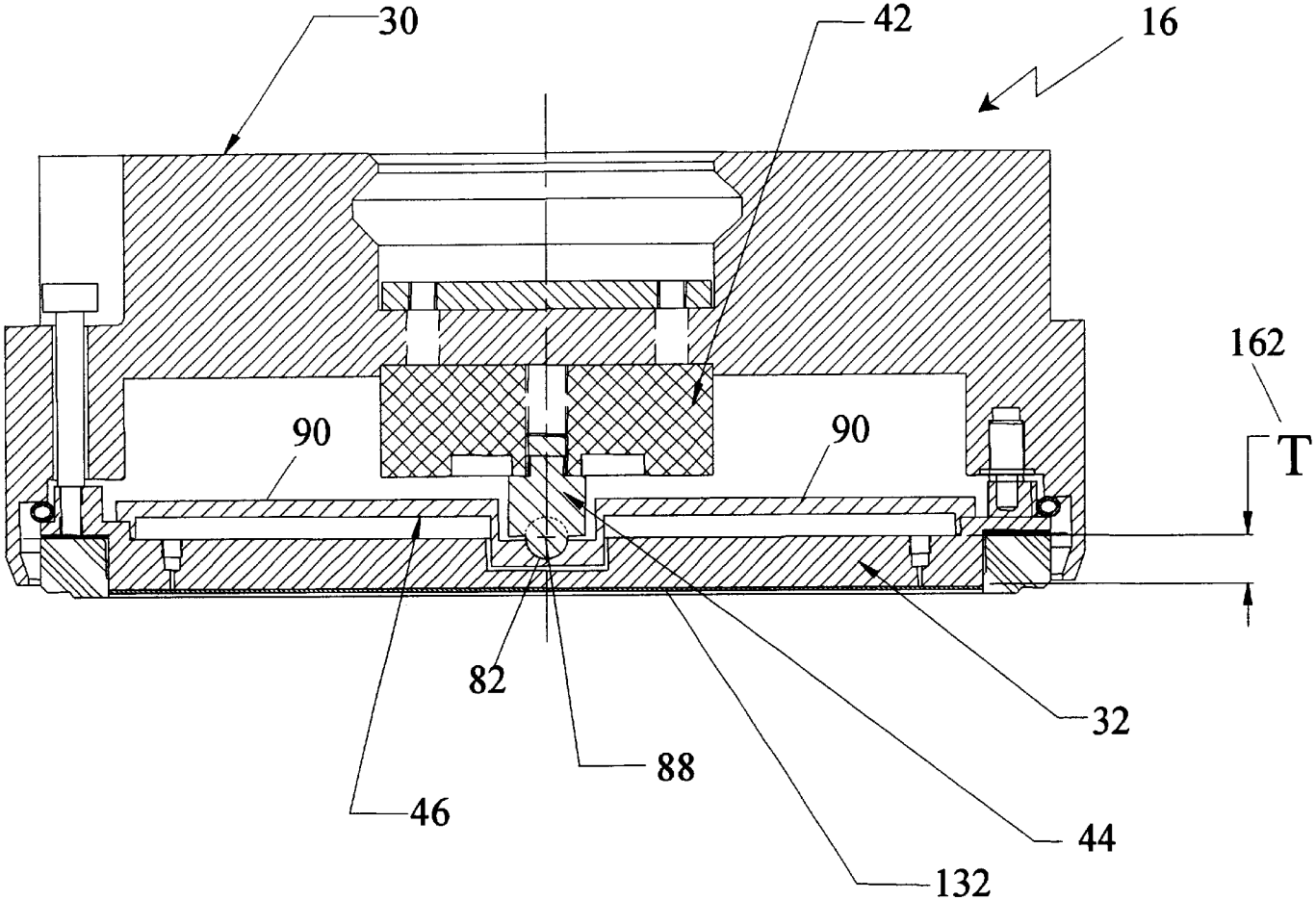
FIG. 8 is a cross section of another presently preferred embodiment of the polishing head assembly illustrated in FIG. 5.
Figure 9:
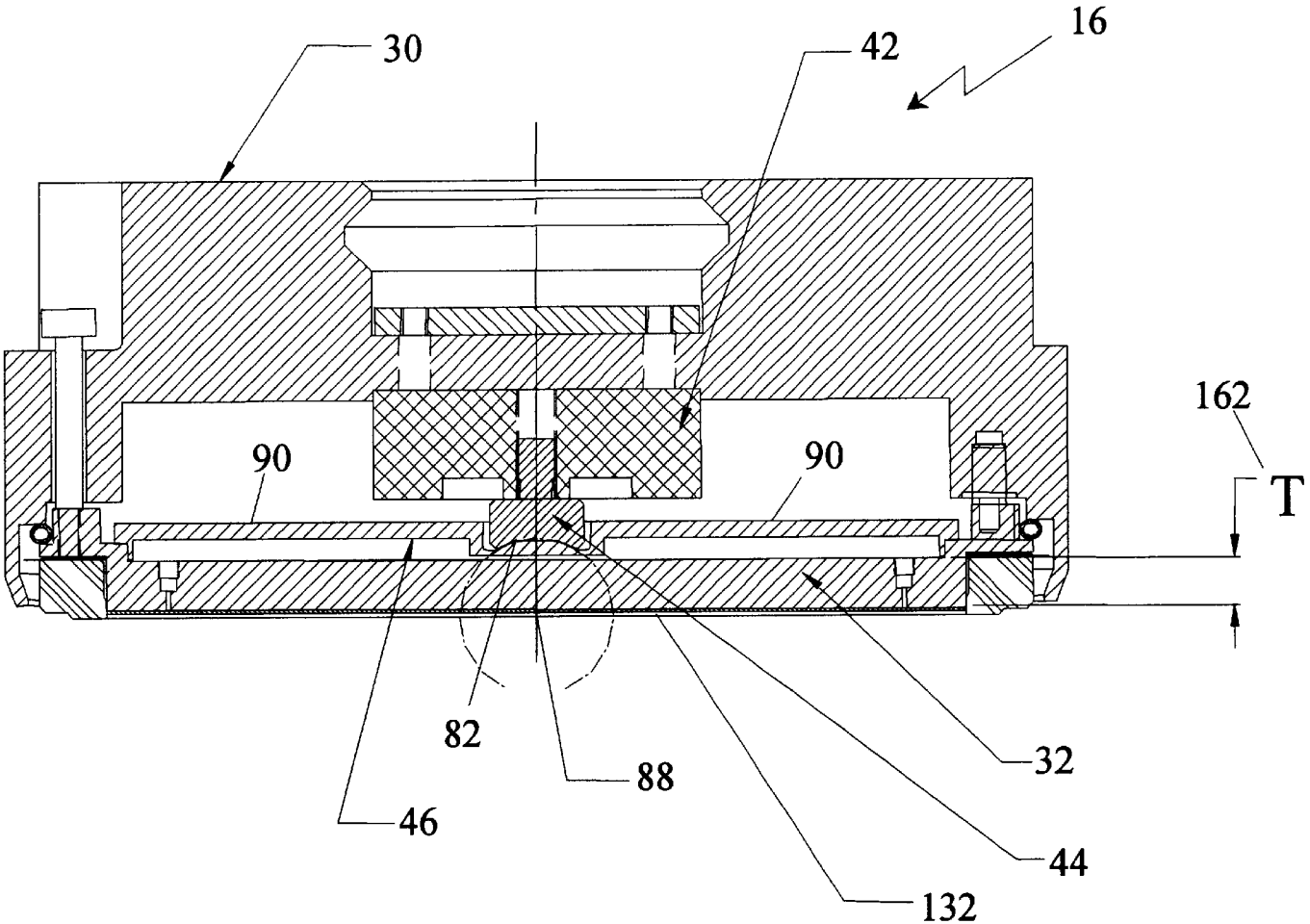
FIG. 9 is a cross section of another presently preferred embodiment of the polishing head assembly illustrated in FIG. 6.

FIGS. 8 and 9 are additional presently preferred embodiments of the wafer polishing assembly 16 illustrated in FIGS. 5 and 6, respectively. These embodiments include the head retainer assembly 30 movably coupled to the wafer carrier head 32 as in the previously discussed embodiments. In addition, the load cell 42 and the gimbal post 44 are fixedly coupled. Further, the gimbal post 44 and the load suspension plate 46 operably cooperated to form a ball and socket. However, in these embodiments, the wafer carrier head 32 is formed with a thickness (T) 162 that is less than the thickness of the previously disclosed embodiments. Accordingly, the deformation of the wafer carrier head 32 when the loading force is applied to the wafer polishing assembly 16 is different. The presently preferred wafer carrier head 32 of these embodiments is formed of stainless steel with a thickness of approximately 0.50 inches.

The load suspension plate 46 contacts the region of the wafer carrier head 32 with the load control ring 90 as in the previously discussed embodiments to transfer the loading force. As in the previous embodiments, adjustment of the diameter of the load control ring 90 controls the deformation of the wafer carrier head 32. Optimization of the flatness of the wafer 20 (illustrated in FIG. 1) is accomplished by adjusting the diameter of the load control ring 90. In the embodiments illustrated in FIGS. 8 and 9, the diameter of the load control ring 90 is adjusted in the range of between approximately 80% to 95% of the diameter of the bottom surface 132 of the wafer carrier head 32. The range of the diameter of the load control ring 90 of these presently preferred embodiments optimizes the flatness of the wafer 20 (illustrated in FIG. 1).

Referring again to FIG. 1 the presently preferred wafer polishing assembly 16 is operable to control the tilt and the flatness of the wafer 20 during a polishing operation. Control of the tilt and the flatness results in maintenance of the wafer 20 in a plane that is parallel to the polishing pad 18. Control of the tilt and the flatness is accomplished using the gimbal post 44 and the load suspension plate 46. The gimbal post 44 is operable to allow the wafer carrier head 32 with the wafer 20 thereon to gimbal thereby optimizing the parallel position of the wafer 20 with respect to the polishing pad 18. The load suspension plate 46 is operable to distribute the loading force to control the deformation of the wafer carrier head 32. Control of the deformation of the wafer carrier head 32 optimizes the flatness of the wafer 20 thereby further optimizing the parallel position of the wafer 20 with respect to the polishing pad 18. Optimization of the parallel position of the wafer 20 provides for more uniform planarization and polishing of the wafer 20.

The embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A polishing head assembly for retaining and manipulating an object having a surface that is subject to polishing, the polishing head assembly comprising:

a head retainer assembly;

a load suspension plate, the load suspension plate includes a gimbal area and a load control ring;

a gimbal post operably coupled to the head retainer assembly, the gimbal post operable to transfer a loading force to the gimbal area for distribution to the load control ring; and a wafer carrier head movably coupled to the head retainer assembly, the wafer carrier head operably engaged with the load control ring and deformable with the loading force to optimize flatness of an object retained on the carrier head.

2. A polishing head assembly for retaining and manipulating an object having a surface that is subject to polishing, the polishing head assembly comprising:

a head retainer assembly, wherein the head retainer assembly is configured to rigidly engage a rotatable spindle;

a gimbal post coupled to the head retainer assembly;

a load suspension plate having a first surface and a second surface, wherein the gimbal post is operably engagable with the load suspension plate and the head retainer assembly is separated from the load suspension plate by die gimbal post: and a wafer carrier head movably coupled to the head retainer assembly having a top surface and a bottom surface, wherein the top surface of the wafer carrier head is operably engaged with the second surface of the load suspension plate and the bottom surface of the wafer carrier head is operable to retain the object.

3. A polishing head assembly for retaining and manipulating an object, having a surface that is subject to polishing, the polishing head assembly comprising:

a head retainer assembly, wherein the head retainer assembly is configured to rigidly engage a rotatable spindle;

a gimbal post coupled to the head retainer assembly;

a load suspension plate having a first surface and a second surface, wherein the gimbal post is operably engagable with the load suspension plate; and a wafer carrier head movably coupled to the head retainer assembly having a top surface and a bottom surface, wherein the top surface of the wafer carrier head is operably engaged with the second surface of the load suspension plate and the bottom surface of the wafer carrier head is operable to retain the object;

wherein the gimbal post comprises a first section positioned adjacent to a second section, wherein the first section operably cooperates with the second section to allow the second section, the load suspension plate and the wafer carrier head to gimbal with respect to the first section.

4. The polishing head assembly of claim 3 wherein the object is a semiconductor wafer.

5. The polishing head assembly of claim 3 wherein the gimbal post operably cooperates with the load suspension plate to allow the load suspension plate and the wafer carrier head to gimbal with respect to the head retainer assembly.

6. The polishing head assembly of claim 5 wherein a distal end of the gimbal post includes a convex area and the load suspension plate includes a concave area that operably cooperates with the convex area to allow the load suspension plate and the wafer carrier head to gimbal with respect to the head retainer assembly.

7. The polishing head assembly of claim 5 wherein a distal end of the gimbal post includes a concave area and the load suspension plate includes a convex area that operably cooperates with the concave area to allow the load suspension plate and the wafer carrier head to gimbal with respect to the head retainer assembly.

8. The polishing head assembly of claim 3 wherein a loading force applied to the head retainer assembly is transferable to the wafer carrier head by the gimbal post and the load suspension plate.

9. The polishing head assembly of claim 3 wherein the diameter of the suspension plate is selectable to control deformation of the wafer carrier head.

10. The polishing head assembly of claim 3 wherein loading applied to the gimbal post is transferable to the load suspension plate, the load suspension plate operable to uniformly apply loading to deform the wafer carrier head to optimize flatness of the object.

11. The polishing head assembly of claim 3, wherein the load suspension plate is operable to deform the wafer carrier head to optimize flatness of the object.

12. A polishing head assembly for retaining and manipulating an object having a surface that is subject to polishing, the polishing head assembly comprising:

a head retainer assembly, wherein the head retainer assembly is configured to rigidly engage a rotatable spindle;

a gimbal post coupled to the head retainer assembly;

a load suspension plate having a first surface and a second surface, wherein the gimbal post is operably engagable with the load suspension plate; and a wafer carrier head movably coupled to the head retainer assembly having a top surface and a bottom surface, wherein the top surface of the wafer carrier head is operably engaged with the second surface of the load suspension plate and the bottom surface of the wafer carrier head is operable to retain the object;

wherein the load suspension plate operably engages the wafer carrier head with a load control ring.

13. The polishing head assembly of claim 12 wherein the diameter of the load control ring is between about 40% and 60% of the diameter of the bottom surface of the wafer carrier head.

14. The polishing head assembly of claim 12 wherein the diameter of the load control ring is between about 80% and 95% of the diameter of the bottom surface of the wafer carrier head.

15. The polishing head assembly of claim 12, wherein the load control ring is a flat plate.

16. A polishing head assembly for retaining and applying a loading force to an object having a surface that is subject to polishing by a polishing pad, the polishing head assembly comprising:

a wafer carrier bead detachably coupled to the object, wherein the wafer carrier head is operable to retain the object and maintain the object in contact with the polishing pad;

a head retainer assembly movably coupled to the wafer carrier head, wherein the head retainer assembly is configured to rigidly engage a rotatable spindle;

a load suspension plate operably engaged with the wafer carrier head wherein the load suspension plate is operable to control deformation of the wafer carrier head; and a gimbal post operably coupled to the head retainer assembly and operably engagable with the load suspension plate, wherein lie loading force applied to the head retainer assembly is transferable to the wafer carrier head by the gimbal post and the load suspension plate;

wherein the load suspension plate comprises a gimbal area and a load control ring.

17. The polishing head assembly of claim 16 wherein the load control ring operably contacts a region of the wafer carrier head.

18. The polishing head assembly of claim 17 wherein the region is in a range between about 40% and 60% of the diameter of a surface of the wafer carrier head detachably coupled to the object.

19. The polishing head assembly of claim 17 wherein the region is in a range between about 80% and 95% of the diameter of a surface of the wafer carrier head detachably coupled to the object.

20. The polishing head assembly of claim 16 wherein the object is a semiconductor wafer.

21. A polishing head assembly for retaining and applying a loading force to an object having a surface that is subject to polishing by a polishing pad, the polishing head assembly comprising:

a wafer carrier head detachably coupled to the object, wherein the wafer carrier head is operable to retain the object and maintain the object in contact with the polishing pad;

a head retainer assembly movably coupled to the wafer carrier head, wherein the head retainer assembly is configured to rigidly engage a rotatable spindle;

a loud suspension plate operably engaged with the wafer carrier head, wherein the load suspension plate is operable to control deformation of the wafer carrier head; and a gimbal post operably coupled to the head retainer assembly and operably engagable with the load suspension plate, wherein the loading force applied to the head retainer assembly is transferable to the wafer carrier head by the gimbal post and the load suspension plate;

wherein the gimbal post includes a convex area that forms a ball and the load suspension plate includes a concave area that forms a socket, wherein the ball and socket are operably engagable to allow the load suspension plate and the wafer carrier head to gimbal with respect to the head retainer assembly.

22. A polishing head assembly for retaining and applying a loading force to an object having a surface that is subject to polishing by a polishing pad, the polishing head assembly comprising:

a wafer carrier head detachably coupled to the object, wherein the wafer carrier head is operable to retain he object and maintain the object in contact. with the polishing pad;

a head retainer assembly movably coupled to the wafer carrier head, wherein the head retainer assembly is configured to rigidly engage a rotatable spindle;

a load suspension plate operably engaged with the wafer carrier head, wherein the load suspension plate is operable to control deformation of the wafer carrier head; and a gimbal post operably coupled to the head retainer assembly and operably engagable with the toad suspension plate, wherein the loading force applied to the head retainer assembly is transferable to the wafer carrier head by the gimbal post and the load suspension plate;

wherein the gimbal post includes a concave area that forms a socket and the load suspension plate includes a convex area that forms a ball, wherein the ball and socket are operably engagable to allow the loud suspension plate and the wafer carrier head to gimbal with respect to the head retainer assembly.

23. A polishing head assembly for retaining and applying a loading force to an object having a surface that is subject, to polishing by a polishing pad, the polishing head assembly comprising:

a water carrier head detachably coupled to the object, wherein the wafer carrier head is operable to retain the object and maintain the object in contact with the polishing pad;

a head retainer assembly movably coupled to the wafer carrier head, wherein the head retainer assembly is configured to rigidly engage a rotatable spindle:

a load suspension plate operably engaged with the wafer carrier head, wherein the load suspension plate is operable to control deformation of the wafer carrier head; and a gimbal post operably coupled to the bead retainer assembly and operably engagable with the load suspension plate, wherein the loading force applied to the head retainer assembly is transferable to the wafer carrier head by the gimbal post and the load suspension plate;

wherein the gimbal post comprises a first section and a second section, wherein the second section is operable engaged with the load suspension plate and the first section includes a convex area that is operably engagable with a concave area of the second section, wherein the first section operably cooperates with the second section to allow the second section, the load suspension plate and the wafer carrier head to gimbal with respect to the first section.

* * * * *

UNITED STATES PATENT AND TRADEMARK OFFICE

CERTIFICATE OF CORRECTION

PATENT NO. : 6,755,723 B1
DATED : June 29, 2004
INVENTOR(S) : Xuyen N. Pham

It is certified that error appears in the above-identified patent and that said Letters Patent is hereby corrected as shown below:

Column 13,
Line 6, delete “die” and insert -- the --.

Column 14,
Line 45, delete “lie” and insert -- the --.

Column 16,
Line 27, delete “bead” and insert -- head --.

Signed and Sealed this

Thirty-first Day of August, 2004

JON W. DUDAS
*Director of the United States Patent and Trademark Office*